United States Patent [19]

Orrill et al.

[11] 4,180,351

[45] Dec. 25, 1979

[54] METHODS AND APPARATUS FOR SEVERING REINFORCED CONCRETE PILINGS

[75] Inventors: Larry M. Orrill, Arlington; John A. Regalbuto, Fort Worth, both of Tex.

[73] Assignee: Jet Research Center, Inc., Arlington, Tex.

[21] Appl. No.: 909,584

[22] Filed: May 25, 1978

[51] Int. Cl.[2] ..... E02B 1/00

[52] U.S. Cl. ..... 405/303; 30/DIG. 4

[58] Field of Search ..... 61/63, 89, 94, 98; 30/180, 358, DIG. 4, 92; 83/639; 405/224, 303

[56] References Cited

U.S. PATENT DOCUMENTS

| | | | |
|---|---|---|---|
| 3,336,759 | 8/1967 | Copper | 61/98 |
| 3,352,119 | 11/1967 | Manning | 61/98 |
| 3,482,484 | 12/1969 | Brizzolara | 30/180 X |
| 3,643,329 | 2/1972 | Lieberman | 30/180 |

*Primary Examiner*—Mervin Stein

*Attorney, Agent, or Firm*—Thomas R. Weaver; J. H. Tregoning; C. Clark Dougherty, Jr.

[57] ABSTRACT

Methods and apparatus for severing concrete pilings containing one or more longitudinally extending reinforcing rods are provided. The apparatus is comprised of at least one elongated barrel, a projectile positioned within the barrel, remotely detonatable explosive means attached to the barrel for propelling the projectile through the barrel into contact with the piling and means for clamping the barrel to the piling.

12 Claims, 6 Drawing Figures

METHODS AND APPARATUS FOR SEVERING REINFORCED CONCRETE PILINGS

At offshore and other locations, concrete pilings containing longitudinally extending reinforcing rods are often constructed. For example, offshore oil and gas well production platforms are commonly supported by a plurality of reinforced concrete pilings extending from above the surface of a body of water into the earth below the body of water. When it is desired to remove such concrete pilings, because they contain reinforcing rods they cannot readily be severed using conventional explosives or other severing means. Generally, such pilings must be severed beneath the surface of the earth below the body of water and removed from the body of water in order to prevent obstructions from being left in the body of water.

By the present invention, methods and apparatus for severing reinforced concrete pilings are provided which are particularly suitable for removing reinforced concrete pilings extending through a body of water.

In accordance with the method of the present invention, a concrete piling containing one or more longitudinally extending reinforcing rods is severed by positioning an apparatus including at least one projectile gun adjacent the piling transversely to the reinforcing rods at a point thereon where it is desired to sever the piling. The projectile gun includes an elongated barrel, a projectile positioned within the barrel of a size and shape capable of penetrating the piling and severing the reinforcing rods upon striking the piling and remotely detonatable explosive means attached to the barrel for propelling the projectile through the barrel and into contact with the piling. After the apparatus is positioned on the piling, the explosive means are detonated causing the projectile to be propelled into forcible contact with the piling and the piling to be severed.

In the drawings forming a part of this disclosure,

Figure 1:
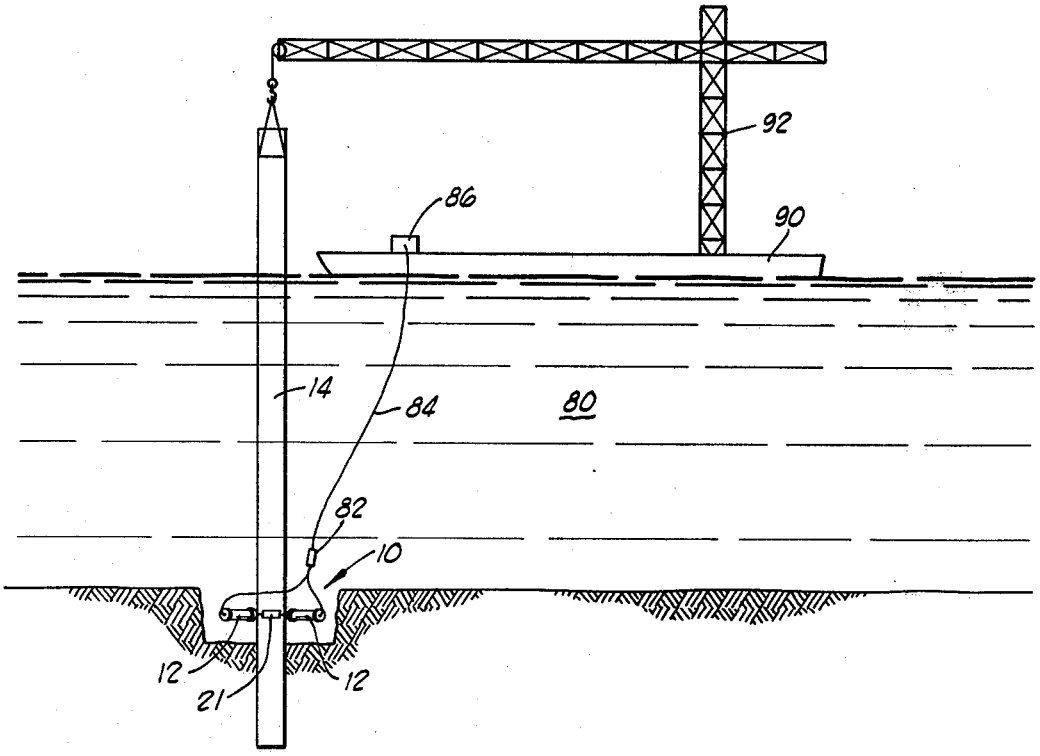
FIG. 1 is an illustration of a reinforced concrete piling extending from a point above a body of water into the earth below the body of water with apparatus of the present invention for severing the piling attached thereto.
Figure 2:
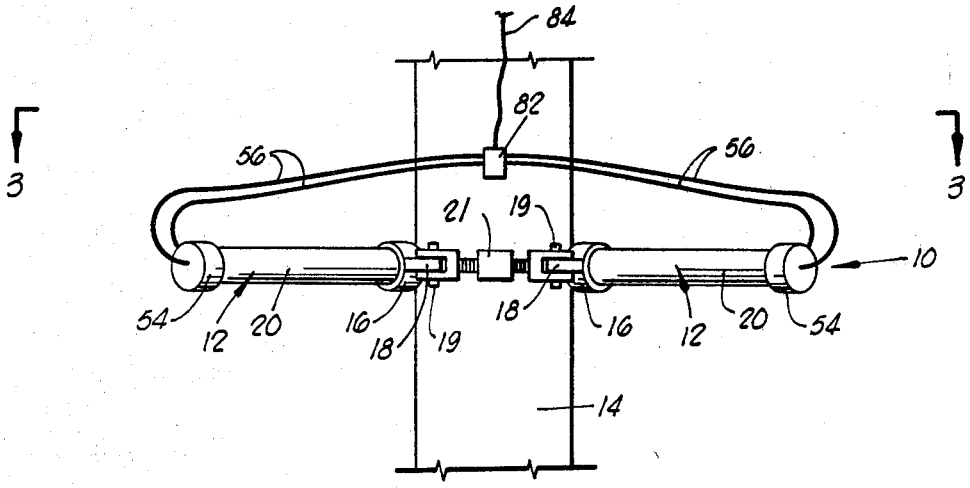
FIG. 2 is an enlarged partial view of the piling and the apparatus of the present invention of FIG. 1.
Figure 3:
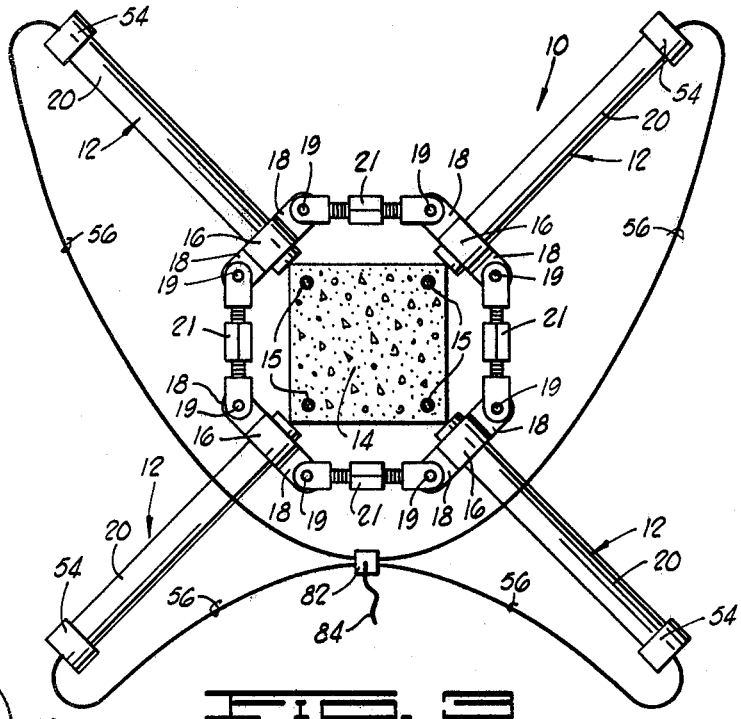
FIG. 3 is a cross-sectional view of the piling and apparatus of FIG. 2 taken along line 3—3 thereof.

Referring now to the drawings, and particularly to FIGS. 1 through 3, the apparatus of the present invention is generally designated by the numeral 10. In the embodiment illustrated, the apparatus 10 is comprised of four identical projectile guns 12 clamped to a piling 14 of square cross-section and containing four reinforcing rods 15. As shown best in FIGS. 2 and 3, each of the projectile guns 12 includes a yoke 16 attached to the forward end thereof. Each of the yokes 16 includes a pair of oppositely extending arms 18 to which conventional turnbuckles 21 are attached. That is, adjacent arms 18 of the yokes 16 are connected together by four turnbuckles 21 so that the projectile guns 12 are clamped in spaced relationship around and to the piling 14.

Figure 4:
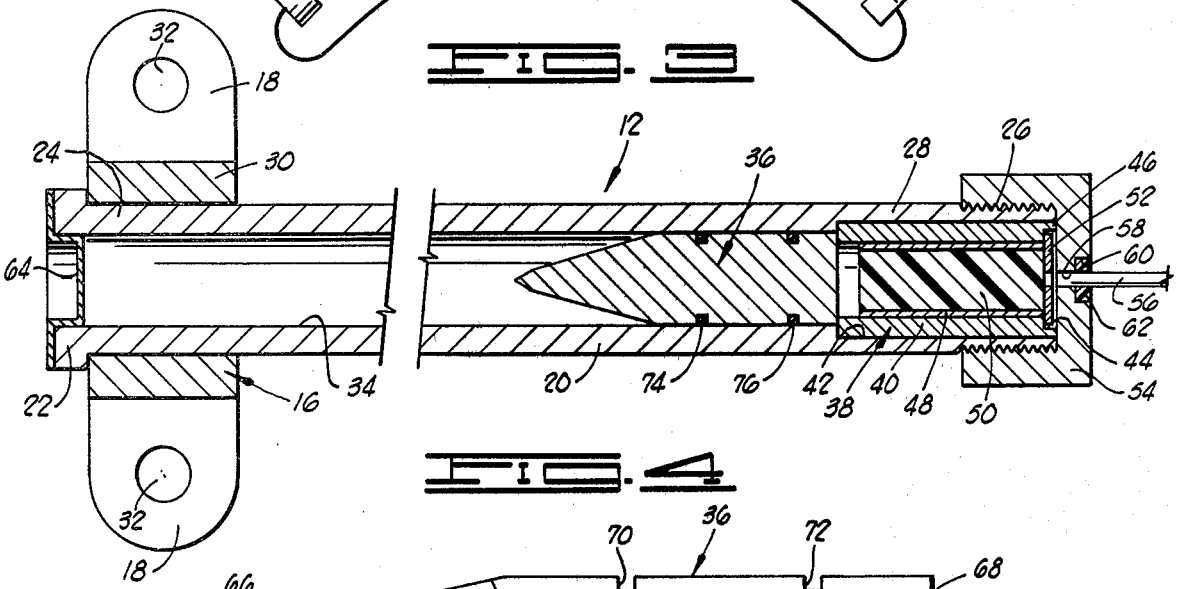
FIG. 4 is an enlarged side view of a projectile gun of the apparatus of the present invention taken in cross-section.

As best shown in FIG. 4, the projectile guns 12 of the apparatus 10 are each comprised of an elongated barrel 20 having an enlarged flange portion 22 at the forward end 24 thereof, and external threads 26 at the rearward end 28 thereof. The yoke 16 is formed of a sleeve 30 which abuts the flange 22 at the forward end 24 of the barrel 20. Preferably, the sleeve 30 is sized so that it can be readily slipped onto and removed from the barrel 20. The pair of oppositely extending arms 18 attached to the sleeve 30 include openings 32 formed therein for attachment to the turnbuckles 21.

Positioned within the bore 34 of the barrel 20 is a projectile 36 which will be described in further detail hereinbelow. Positioned rearwardly of the projectile 36 at the rearward end 28 of the barrel 20 is an explosive cartridge assembly generally designated by the numeral 38. The assembly 38 includes a cylindrical cartridge holder 40 which is disposed in a counterbore 42 formed interiorly of the barrel 20 at the rearward end 28 thereof. The cartridge holder 40 includes an annular recess 44 at its rearward end 46. A conventional cartridge 48 containing explosive material 50 and having a retaining rim 52 at the rearward end thereof is removably inserted in the cartridge holder 40. As will be understood, the rim 52 of the cartridge 48 fits within the annular recess 44 at the rearward end of the cartridge holder 40 which prevents the cartridge 48 from moving forwardly within the cartridge holder 40. The cartridge holder 40 is in turn prevented from moving forwardly by the recess 42 formed within the barrel 20.

A firing cap 54 is threadedly connected to the rearward end 28 of the barrel 20 by means of the threads 26 thereon. The firing cap 54 closes the rearward end 28 of the barrel 20 and prevents the cartridge 50 and cartridge holder 40 from moving rearwardly. The end of a conventional detonating cord 56 or other form of electrical or exploding detonator for the cartridge 50 is disposed in an axially positioned bore 58 formed in the firing cap 54. A counterbore 60 is formed at the rearward end of the bore 58 in the cap 54, and a quantity of conventional sealing composition 62 is disposed within the counterbore 60 to provide a water-tight seal between the detonating cord 56 and the firing cap 54.

A frangible cap 64, formed of plastic material or the like, is adhered to the forward end of the barrel 20 to prevent water from entering the bore 34 of the barrel 20.

In operation of the projectile gun 12, the projectile 36 is positioned adjacent the cartridge holder 40 and the cartridge 48 so that upon detonation of the explosive material 50 within the cartridge 48, the gases formed thereby cause the projectile 36 to be forcibly propelled through the bore 34 of the barrel 20.

Figure 5:
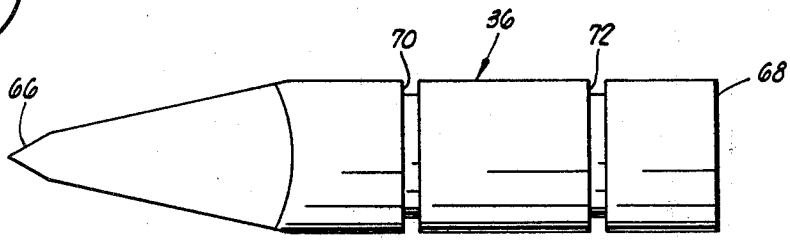
FIG. 5 is an enlarged side view of the projectile of the projectile gun of FIG. 4.
Figure 6:
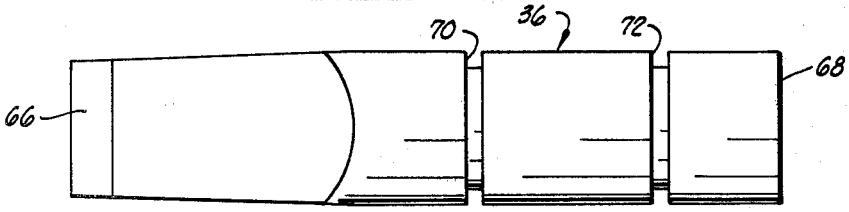
FIG. 6 is a top view of the projectile of FIG. 5.

Referring now to FIGS. 5 and 6, the projectile 36 of each of the projectile guns 12 is illustrated in detail. The projectile 36 is cylindrical in shape and has an outside diameter slightly less than the inside diameter of the bore 34 of the barrel 20 so that it freely moves through the bore 34 when propelled by the detonation of the explosive material 50. In a preferred embodiment, the forward end 66 of the projectile 36 terminates in a sharp wedge-shaped point. The rearward end 68 of the projectile 36 is flat, and a pair of continuous grooves 70 and 72 are disposed in the peripheral surface of the cylindrical portion of the projectile 36. The grooves 70 and 72 are spaced from each other and are each of a size suitable for containing conventional resilient seal members 74 and 76 (FIG. 4), i.e., O-ring seals. The seals 74 and 76 provide a seal between the grooves 70 and 72 of the projectile 36 and the surfaces of the bore 34 of the barrel 20 so that gases formed by the detonation of the explosive material 50 do not escape between the outside surfaces of the projectile 36 and the surfaces of the bore 34.

Referring again to FIGS. 1 through 3, in carrying out the method of the present invention for severing the reinforced concrete piling 14, the apparatus 10 is positioned on the piling 14 at a point where it is desired to sever the piling. The turnbuckles 21 are connected to the arms 18 of the projectile guns 12 by bolts or pins 19 which extend through the openings 32 in the arms 18, and are tightened to clamp the apparatus 12 on the piling 14. Each of the projectile guns 12 is positioned in a plane transverse to the longitudinally extending reinforcing rods 15 contained in the piling 14. Preferably, the apparatus 10 includes a number of projectile guns 12 equal to the number of reinforcing rods 15, and each of the projectile guns 12 is positioned in alignment with one of the reinforcing rods 15 as illustrated in FIG. 3. The detonating cords 56 connected to the firing caps 54 of the projectile guns 12 are connected to a blasting cap 82 or other equivalent means. As shown in FIG. 1, the blasting cap 82 is in turn connected by a suitable electric firing line to a remotely positioned blasting generator 86. When the blasting generator 86 is activated, the blasting cap 82 is detonated which simultaneously detonates the detonating cords 56 connected to the projectile guns 12. The detonation of the cords 56 causes the explosive material 50 of the cartridges 48 of the projectile guns 12 to be detonated and the projectiles 36 to be forcibly propelled through the barrels 20 thereof into forcible contact with the piling 14, penetrating the concrete thereof and cutting the reinforcing rods 15 whereby the piling is severed.

A single projectile gun 12 or a plurality of projectile guns 12 can be utilized in severing reinforced concrete pilings. However, as indicated above, a number of projectile guns 12 equal to the number of reinforcing rods in the piling to be severed are preferably utilized in the apparatus 10. The projectile guns 12 are spaced around the piling with the barrels thereof positioned in a plane transverse to the reinforcing rods in the piling, preferably with each of the barrels in alignment with one of the reinforcing rods. This arrangement insures that each of the reinforcing rods is cut by a projectile 36 upon forcibly striking the piling.

Referring now to FIG. 1, in carrying out the method of this invention for severing a reinforced concrete piling 14 extending through a body of water 80 into the earth beneath the body of water, a portion of the earth is preferably excavated from around the bottom of the piling 14. A barge 90 having a crane 92 thereon is positioned adjacent the top of the piling 14, and the crane 92 is connected by appropriate cable connectors to the piling 14. The apparatus 10 of the invention is positioned, such as by divers, on the piling 14 at a point beneath the surface of the earth below the body of water 80 so that when severed, the bottom portion of the piling remaining in the earth is below the surface thereof. After the apparatus 10 has been clamped on the piling 14 at the desired point, the detonating cords 56 are connected to the blasting cap 82 which is in turn connected by the firing line 84 to the blasting generator 86 positioned on the barge 90. The blasting generator 86 is then activated causing the projectiles 36 of the projectile guns 12 to simultaneously forcibly strike the piling 14, cutting the reinforcing rods 15 contained therein and severing the piling 14. The severed upper portion of the piling 14 is then removed by means of the barge 90 and crane 92.

As will be understood by those skilled in the art, more than one piling can be simultaneously severed by installing an apparatus 10 on each of the pilings. Further, the apparatus 10 can be utilized in accordance with the methods of this invention to sever reinforced concrete pilings of varying cross-sectional shapes containing any number of reinforcing rods. Also, this invention is not limited to the severing and removal of reinforced concrete pilings extending through a body of water, but finds utility in a variety of applications. While presently preferred embodiments of this invention have been described herein for purposes of disclosure, numerous changes in the construction and arrangement of parts will suggest themselves to those skilled in the art, which changes are encompassed within the spirit of this invention as defined by the appended claims.

What is claimed is:

1. A method of severing a concrete piling containing two or more longitudinally extending reinforcing rods comprising the steps of:

positioning at least two projectile guns around said piling in a plane transverse to said reinforcing rods at a point thereon where it is desired to sever said piling, each of said projectile guns being positioned in alignment with one of said reinforcing rods, clamping said projectile guns together and to said piling, said projectile guns including an elongated barrel, a projectile positioned within said barrel of a size and shape capable of penetrating said piling and severing said reinforcing rods upon striking said piling and explosive means attached to said barrel for propelling said projectile through said barrel and into contact with said piling; and simultaneously detonating said explosive means whereby said projectile is caused to penetrate said piling and sever said reinforcing rods.

2. A method of severing a concrete piling containing two or more longitudinally extending reinforcing rods, said piling extending from above the surface of a body of water into the earth below the body of water comprising the steps of:

positioning at least two projectile guns around said piling in a plane transverse to said reinforcing rods at a point thereon beneath the surface of said body of water near the bottom of said piling, each of said projectile guns being positioned in alignment with one of said reinforcing rods, clamping said projectile guns together and to said piling, said projectile guns including an elongated barrel, a projectile positioned within said barrel of a size and shape capable of penetrating said piling and severing said reinforcing rods upon striking said piling and explosive means attached to said barrel for propelling said projectile through said barrel and into contact with said piling; and simultaneously detonating said explosive means whereby said projectile is caused to strike said piling and said piling is severed at said point near the bottom of said piling.

3. The method of claim 2 which is further characterized to include the step of connecting the top of said piling to a barge prior to detonating said explosive means so that upon severing said piling, said piling is retained in a vertical position by said barge for removal from said body of water.

4. The method of claim 3 which is further characterized to include the steps of excavating earth from around the bottom of said piling prior to positioning said projectile guns adjacent said piling and positioning said projectile guns beneath the surface of the earth below said body of water.

5. A projectile gun for severing a concrete piling containing one or more longitudinally extending reinforcing rods which comprises:

an elongated barrel having a cylindrical bore extending therethrough, a forward end and a rearward end;

a cylindrical projectile having a wedge-shaped, sharpened forward end, positioned within said cylindrical bore of said barrel, the outside diameter of said projectile being slightly less than the inside diameter of said barrel;

said projectile including at least one continuous groove formed around the periphery thereof in a plane transverse to the axis of said projectile; and resilient seal means positioned within said groove for providing a slidable seal between said projectile and said bore, said projectile having a size and shape capable of penetrating said piling and severing said reinforcing rods upon striking said piling with said wedge-shaped, sharpened forward end;

explosive means attached to the rearward end of said barrel for propelling said projectile through said forward end of said bore into contact with said piling;

means for remotely detonating said explosive means attached thereto; and means for clamping the forward end of said barrel to said piling.

6. Apparatus for severing a concrete piling containing a plurality of reinforcing rods extending longitudinally therein which comprises:

a plurality of projectile guns each of which is comprised of:

an elongated barrel having a bore extending therethrough, a forward end and a rearward end;

a projectile positioned within said bore of said barrel of a size and shape capable of penetrating said piling and severing one or more of said reinforcing rods upon striking said piling; and explosive means attached to the rearward end of said barrel for propelling said projectile through said bore into contact with said piling;

means for simultaneously detonating said explosive means of said projectile guns from a remote location attached to said explosive means; and means for clamping the forward ends of the barrels of said projectile guns to said piling and to each other whereby said projectile guns are positioned around said piling in spaced relationships to each other in a plane transverse to said reinforcing rods therein.

7. The apparatus of claim 6 wherein the number of projectile guns in said apparatus is equal to the number of reinforcing rods in said piling and the barrels of said projectile guns are each positioned in alignment with one of said reinforcing rods.

8. The apparatus of claim 7 wherein said means for clamping the forward ends of the barrels of said projectile guns to said piling and to each other are comprised of:

each of said barrels including a pair of oppositely extending arms attached to the forward end thereof; and a plurality of turnbuckles removably attached to and between adjacent arms of said barrels.

9. The apparatus of claim 8 wherein the projectiles of each of said projectile guns is cylindrical in shape and includes a sharpened forward end.

10. The apparatus of claim 9 wherein the sharpened forward ends of said projectiles are wedge-shaped.

11. The apparatus of claim 10 wherein each of said projectile guns is further characterized to include means attached to said projectile for providing a slidable seal between said projectile and the bore of said barrel.

12. The apparatus of claim 11 wherein said means for providing a slidable seal between said projectile and the bore of said barrel are comprised of:

said projectile including at least one continuous groove formed around the periphery thereof in a plane transverse to the axis of said projectile; and resilient seal means positioned within said groove.

* * * * *